US010940483B2

(12) United States Patent
Hoehn et al.

(10) Patent No.: US 10,940,483 B2
(45) Date of Patent: Mar. 9, 2021

(54) MODULAR ROLLER GRINDING MILL

(71) Applicant: Oronoko Ironworks, Inc., Baroda, MI (US)

(72) Inventors: Richard Hoehn, Decatur, IN (US); Richard Riley, III, Galien, MI (US)

(73) Assignee: ORONOKO IRONWORKS, INC., Baroda, MI (US)

( * ) Notice: Subject to any disclaimer, the term of this patent is extended or adjusted under 35 U.S.C. 154(b) by 211 days.

(21) Appl. No.: 16/099,773

(22) PCT Filed: May 11, 2017

(86) PCT No.: PCT/US2017/032090
§ 371 (c)(1),
(2) Date: Nov. 8, 2018

(87) PCT Pub. No.: WO2017/197074
PCT Pub. Date: Nov. 16, 2017

(65) Prior Publication Data

US 2019/0176159 A1 Jun. 13, 2019

Related U.S. Application Data

(60) Provisional application No. 62/335,375, filed on May 12, 2016.

(51) Int. Cl.
*B02C 4/38* (2006.01)
*B02C 4/42* (2006.01)
(Continued)

(52) U.S. Cl.
CPC ..... *B02C 4/38* (2013.01); *B02C 4/02* (2013.01); *B02C 4/06* (2013.01); *B02C 4/08* (2013.01);
(Continued)

(58) Field of Classification Search
CPC .... B02C 4/38; B02C 4/32; B02C 4/02; B02C 4/28; B02C 4/06; B02C 4/08; B02C 4/30; B02C 4/42
See application file for complete search history.

(56) References Cited

U.S. PATENT DOCUMENTS 1,743,911 A * 1/1930 Borton ..... B02C 4/28 241/285.2
3,208,677 A 9/1965 Hesse
(Continued)

OTHER PUBLICATIONS

In Gyou Min; International Search Report—Written Opinion, Parent PCT Application No. PCT/US2017/032090, dated Aug. 21, 2017, ISA/KR KIPO, Daejeon, Republic of Korea.

*Primary Examiner* — Faye Francis
(74) *Attorney, Agent, or Firm* — Babcock IP, PLLC

(57) ABSTRACT

A roller mill module with a fixed grinding roller with a first grind surface rotatably supported within a grind area between a first drive end and a second drive end of a support structure; an adjustable grinding roller with a second grind surface rotatably supported within the grind area; the adjustable grinding roller movable with respect to the fixed grinding roller to adjust a grind gap between the first grind surface and the second grind surface; a drive shaft of the fixed grinding roller and a drive shaft of the adjustable grinding roller extending from the first and the second drive ends of the support structure; and a sample port provided in a front side of the support structure; a sample passage coupled to the sample port extending to a position below the grind area and opposite a sampler stop surface.

18 Claims, 11 Drawing Sheets

(51) Int. Cl.

| | |
|---|---|
| ***B02C 4/32*** | (2006.01) |
| ***B02C 4/02*** | (2006.01) |
| ***B02C 4/28*** | (2006.01) |
| ***B02C 4/06*** | (2006.01) |
| ***B02C 4/08*** | (2006.01) |
| ***B02C 4/30*** | (2006.01) |

(52) U.S. Cl.
CPC ..... *B02C 4/28* (2013.01); *B02C 4/30* (2013.01); *B02C 4/32* (2013.01); *B02C 4/42* (2013.01)

(56) References Cited

U.S. PATENT DOCUMENTS 4,225,093 A * 9/1980 Rusch ..... B02C 4/06 241/159
4,485,977 A * 12/1984 Silverthorn ..... B02C 4/38 241/230
5,544,823 A * 8/1996 Baltensperger ..... B02C 4/06 241/79
6,776,366 B2 8/2004 Tschesche
7,628,347 B2 * 12/2009 Frangenberg ..... B02C 4/02 241/231
8,091,813 B2 * 1/2012 Kirschner ..... B02C 4/32 241/100
8,851,408 B2 10/2014 Bihn
9,289,959 B2 * 3/2016 Frangenberg ..... B30B 15/04
2007/0187538 A1 * 8/2007 Wollenhaupt ..... B30B 15/028 100/210
2008/0296424 A1 * 12/2008 Frangenberg ..... B30B 3/04 241/231
2008/0317933 A1 12/2008 Williamson
2010/0186607 A1 * 7/2010 Horster ..... B02C 4/02 100/176
2016/0101424 A1 * 4/2016 Frerich ..... B30B 3/04 241/230
2018/0326426 A1 * 11/2018 Knecht ..... B02C 23/00

* cited by examiner

MODULAR ROLLER GRINDING MILL

BACKGROUND

Field of the Invention

The invention relates to a grain grinding mill, and more particularly a roller grinding mill with modular ease of service and/or re-configuration characteristics.

Description of Related Art

Roller grinding mills are commonly used in the beer brewing industry to grind grain and the like. Typical grinding mills have been purpose built for high capacities required by high volume beer production.

Competition in the roller mill industry has focused attention on process flexibility, quality control, labor requirements and overall reductions in manufacturing and installation costs.

Therefore, it is an object of the invention to provide a roller mill that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that a growing craft beer brewing industry has created a need for roll mills adapted for use in relatively small batch environments with ease of use characteristics. Equipment serviceability, particularly by small companies that may not have a dedicated staff of mechanics is another factor for commercial success. Further, there is a need for expandability so that initial equipment investments are not lost as a small organization grows/evolves.

Figure 1:
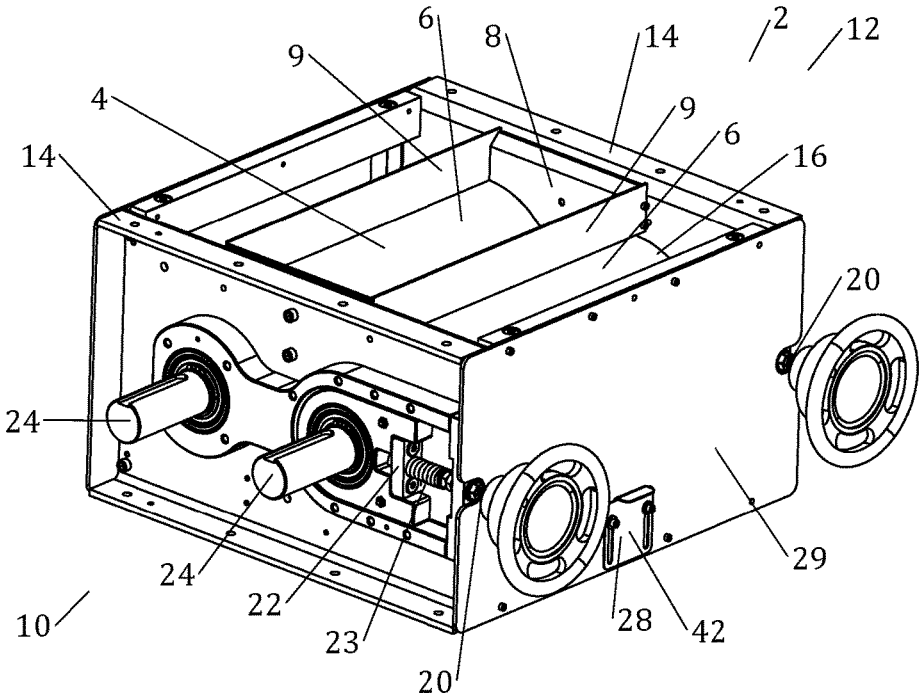
FIG. 1 is a schematic isometric view of an exemplary roller mill drive module.
Figure 2:
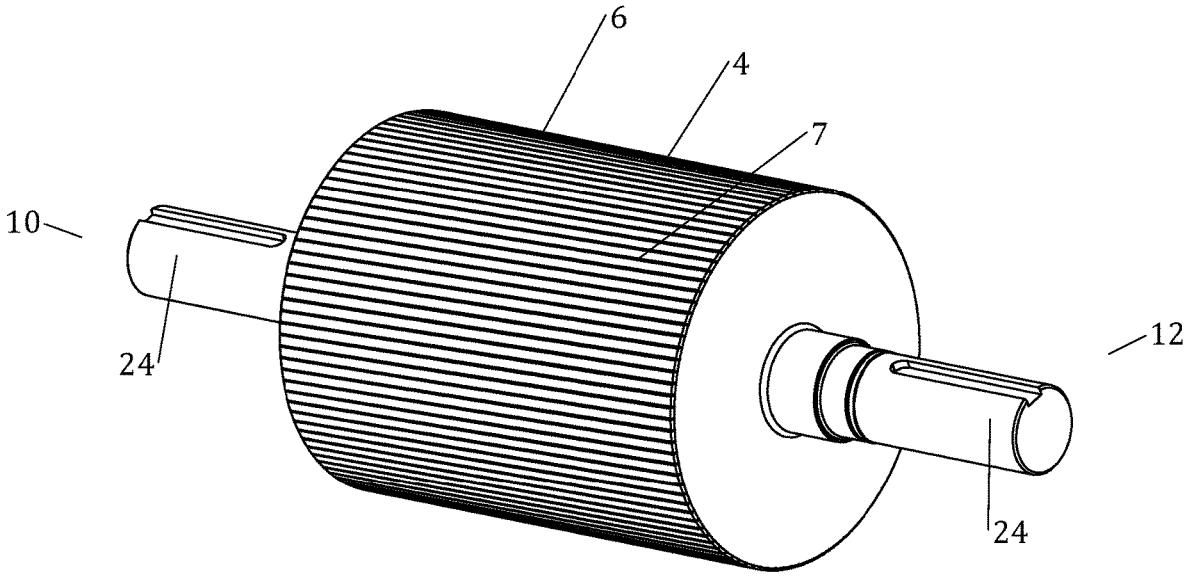
FIG. 2 is a schematic isometric view of an exemplary grinding roller.

As shown for example in FIG. 1, an exemplary roller mill module 2 has a fixed grinding roller 4 with a first grind surface 6 rotatably supported within a grind area 8 between a first drive end 10 and a second drive end 12 of a support structure 14. An adjustable grinding roller 16 with a second grind surface 6 is also rotatably supported within the grind area 8, alongside the fixed grinding roller 4. Baffles 9 extending between the first and second drive ends 10, 12, which define the grind area 8 therebetween, may be applied to guide product towards the grind gap 18.

The fixed and/or adjustable grinding rollers 4, 16 may be provided with grooves 7 or other surface features on the grind surfaces 6. The grooves 7 may be applied, for example, parallel or skewed with respect to a longitudinal axis of the respective fixed and/or adjustable grinding rollers 4, 16.

Figure 3:
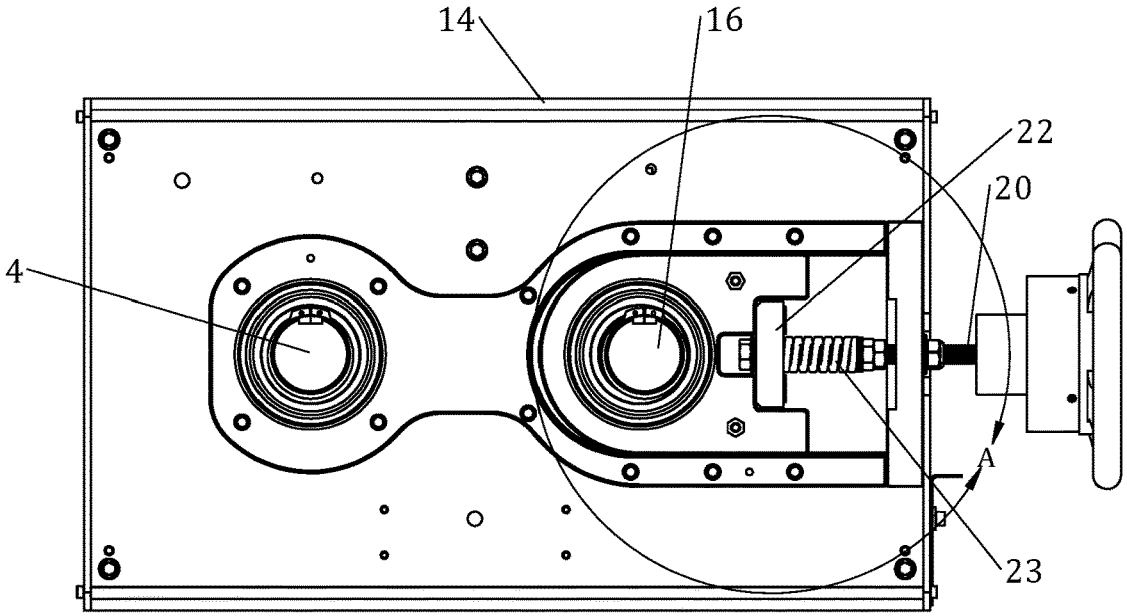
FIG. 3 is a schematic side view of the roller mill module of FIG. 1.
Figure 4:
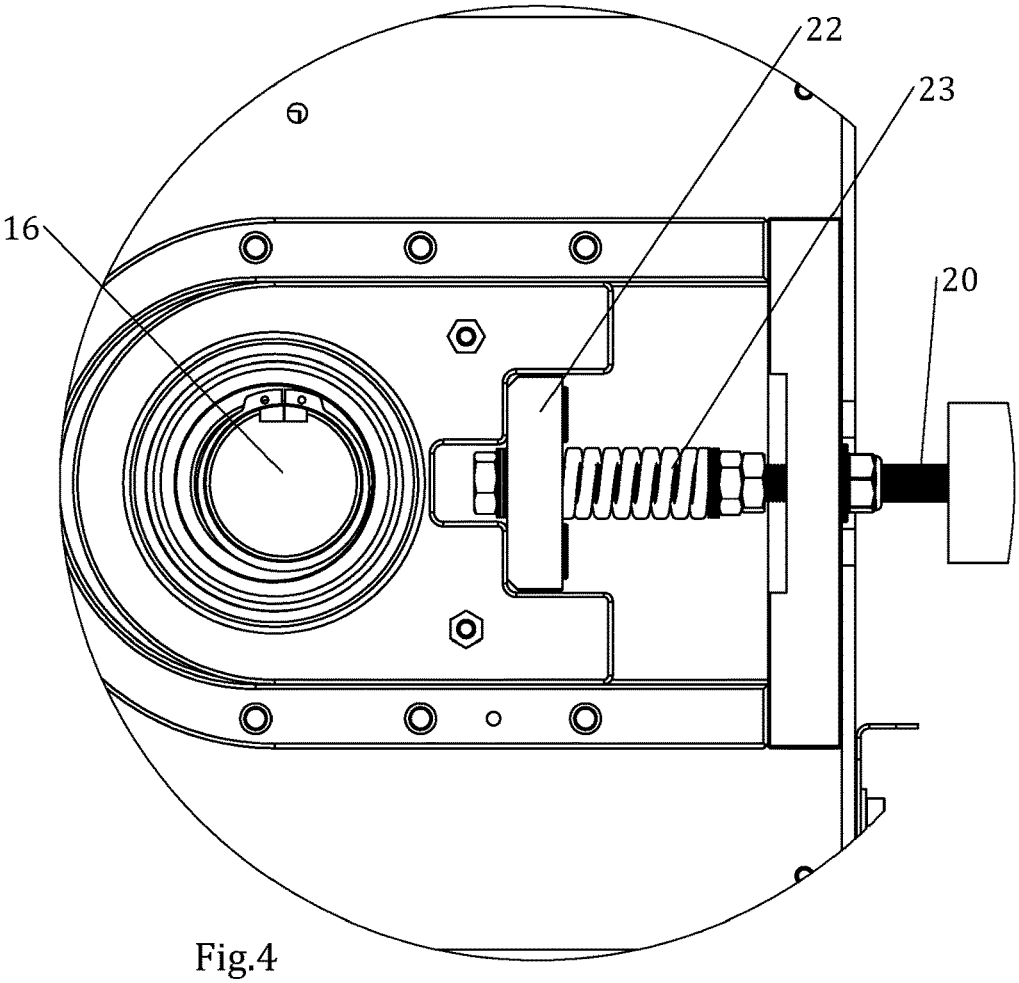
FIG. 4 is a close-up view of area B of FIG. 3.
Figure 16:
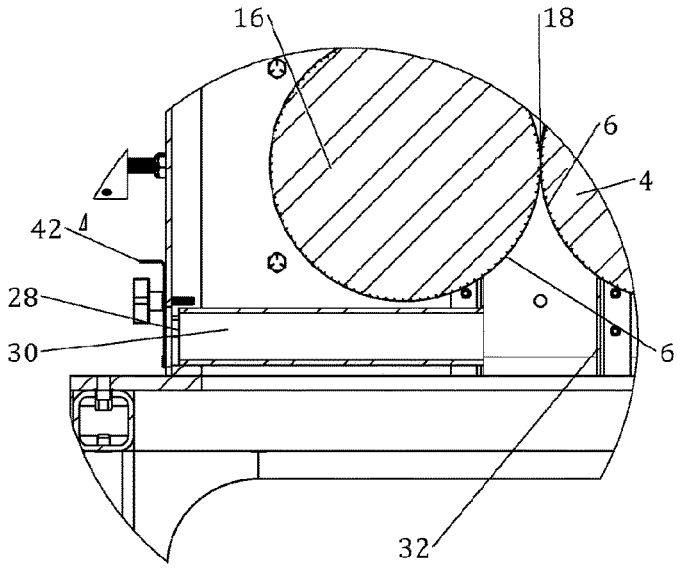
FIG. 16 is a close-up view of area C of FIG. 15.
Figure 15:
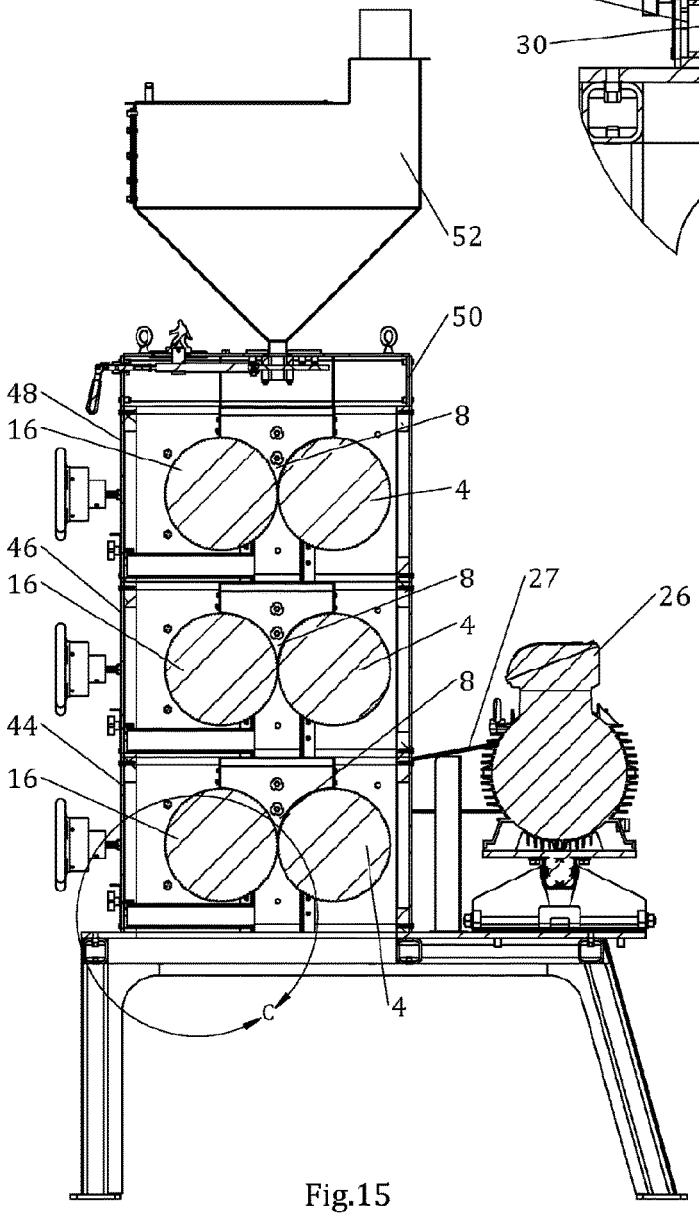
FIG. 15 is a cut-away view taken along line A of FIG. 14.

As best shown in FIGS. 3 and 4, the adjustable grinding roller 16 is movable with respect to the fixed grinding roller 4, for example via a threaded screw 20 pushing and/or pulling a stop surface 22 coupled to the adjustable grinding roller 16 as the screw 20 is rotated to thread into or out of the stop surface 22, to adjust a grind gap 18 (see FIGS. 15 and 16) between the first grind surface 6 and the second grind surface 6. Applying a pair of the screws 20, one at each of the first drive end 10 and the second drive end 12 enables precision adjustment of the grind gap 18, for example placing the fixed and adjustable grinding rollers 4, 16 parallel to one another or skewed as desired to obtain both a desired grind size and/or range of grind sizes.

A spring 23, for example biased against the stop surface 22, may be applied to provide a relief bias for the adjustable grinding roller 16 to reduce damage if an oversize foreign object encounters the grind gap 18.

Figure 5:
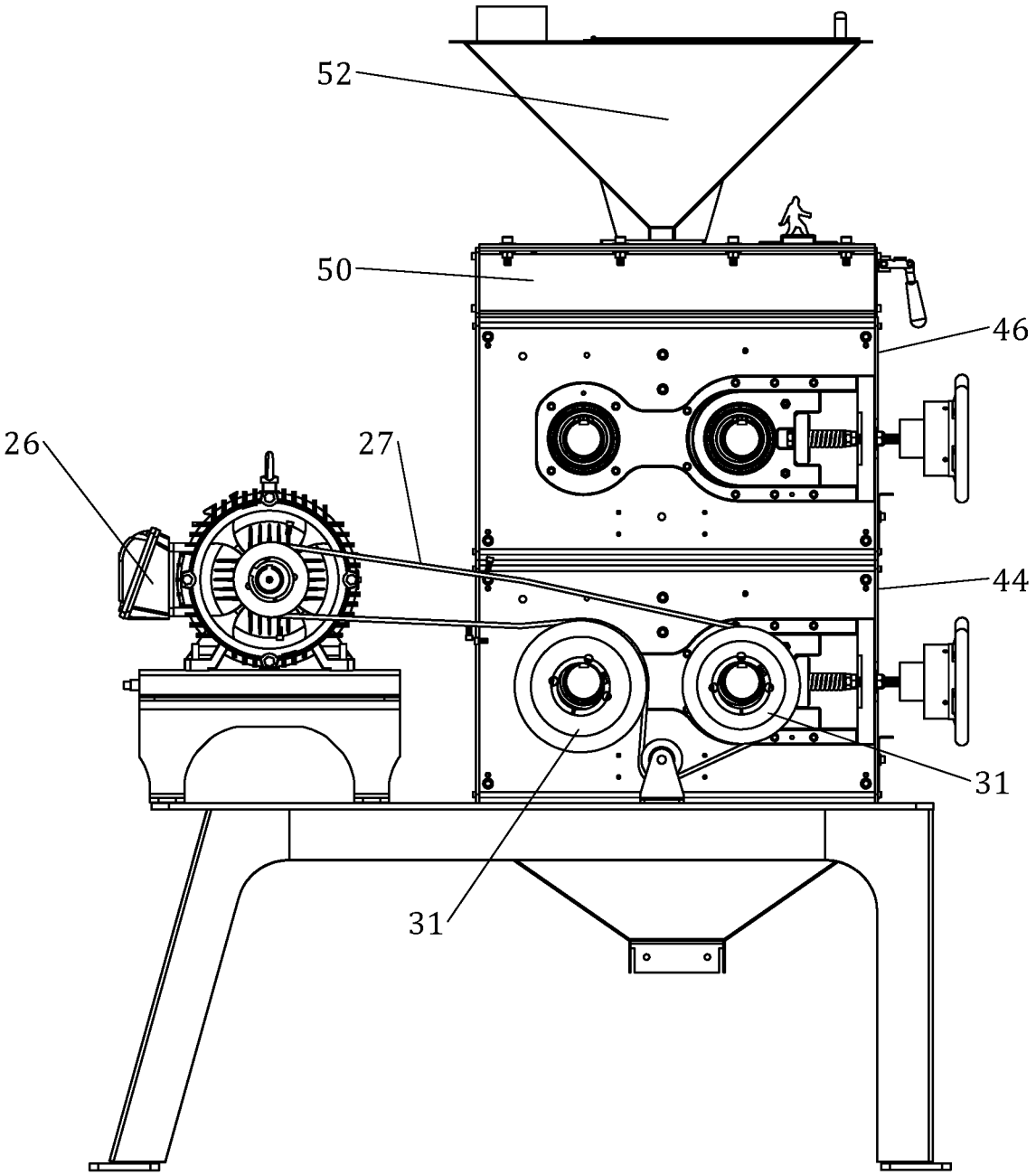
FIG. 5 is a schematic first side view of a two module assembly.
Figure 6:
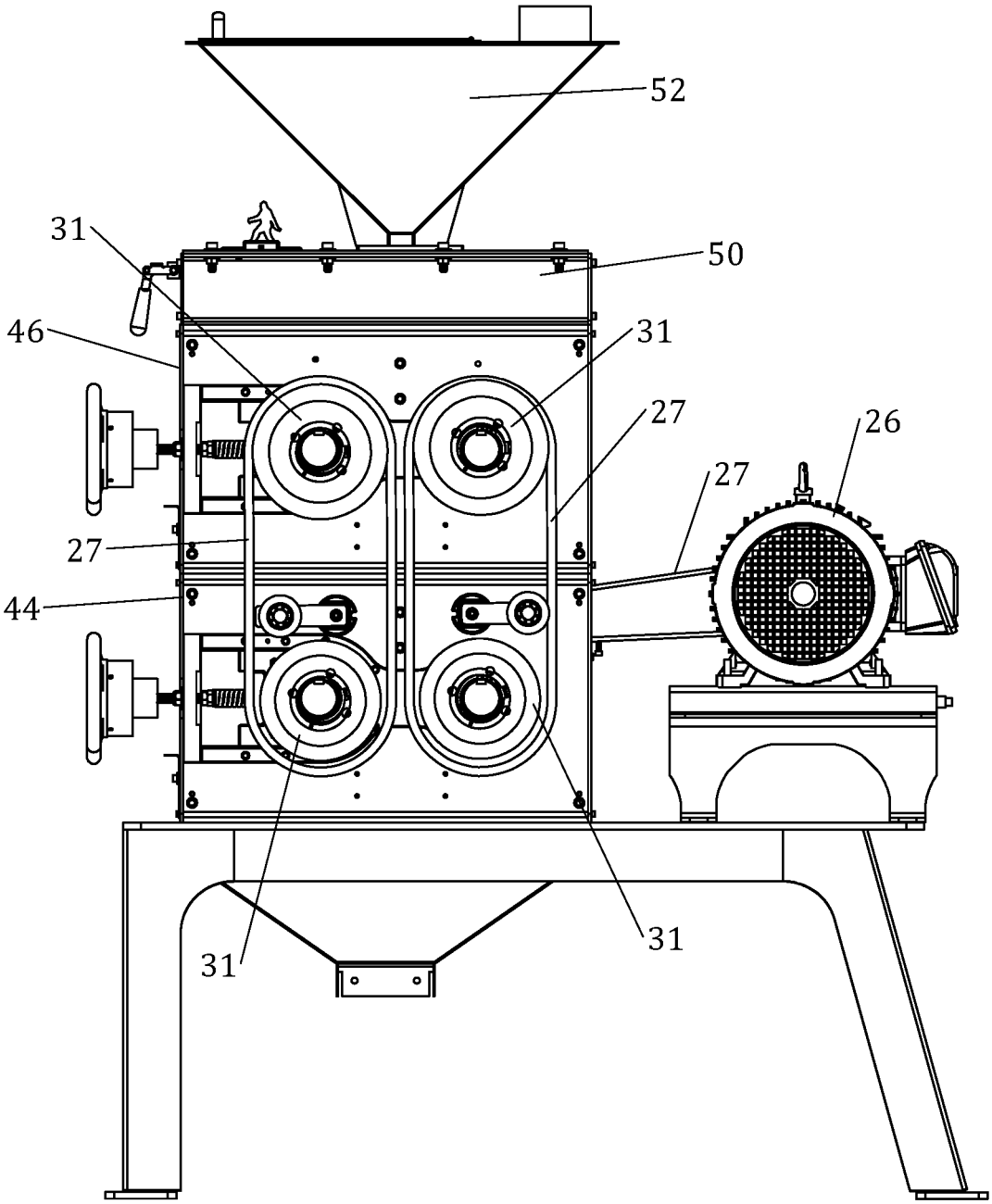
FIG. 6 is a schematic second side view of the assembly of FIG. 5.
Figure 7:
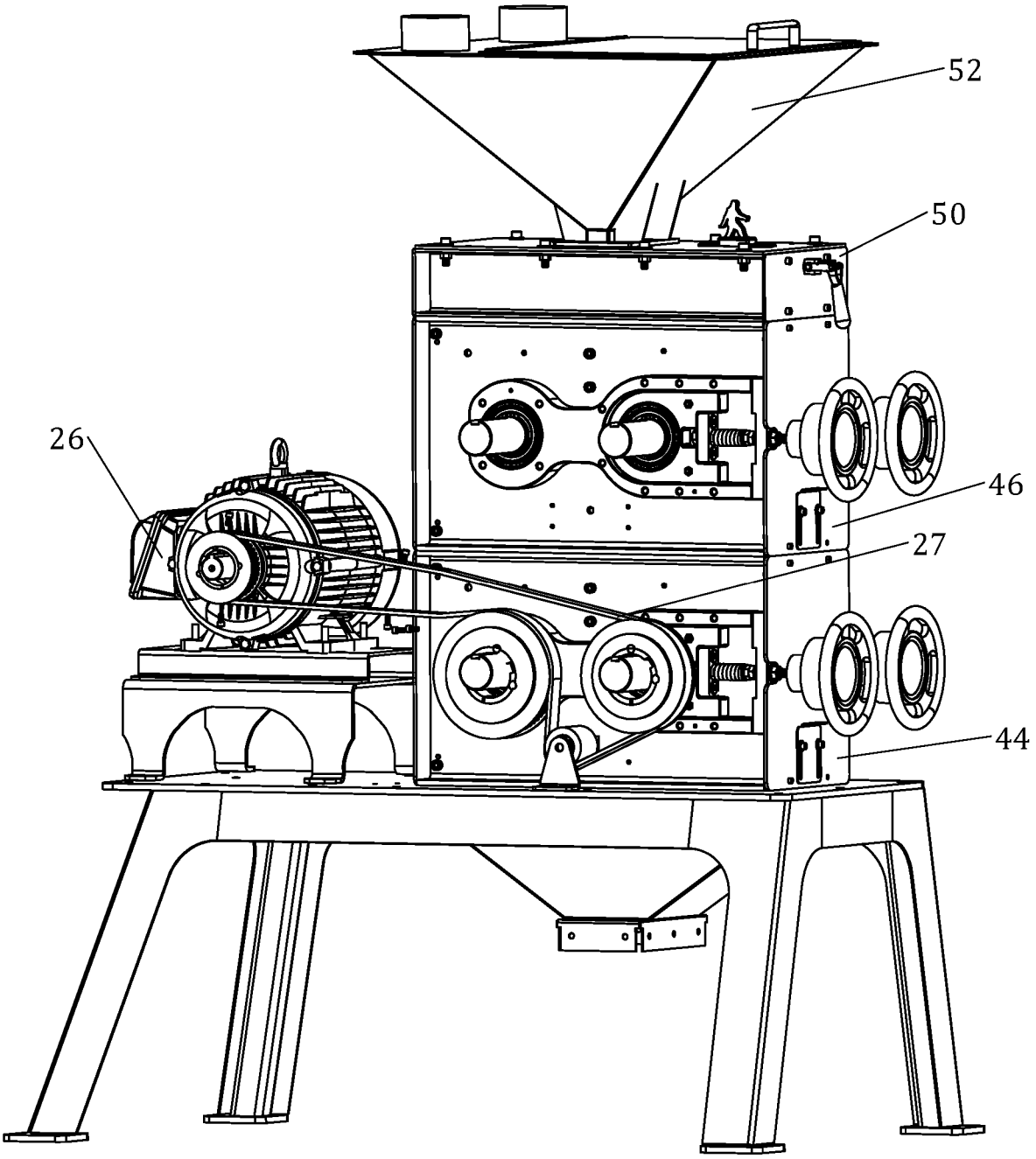
FIG. 7 is a schematic isometric view of the assembly of FIG. 5.

The fixed and adjustable grinding rollers 4, 16 are driven via drive shafts 24 of the fixed grinding roller 4 and the adjustable grinding roller 16 extending from the first and the second drive ends 10, 12 of the support structure 14. As best shown in FIGS. 5-7, a motor 26 is coupled to the drive shafts 24, for example via a belt 27 running upon drive wheels 31 mounted on the drive shaft 24 of the fixed grinding roller 4 and the drive shaft 24 of the adjustable grinding roller 16 outboard of the first drive end 10 of the support structure 14.

One skilled in the art will appreciate that while rotation speed of the rollers is a function of motor 26 speed, set for example by a variable frequency drive, rotation speeds of the fixed and adjustable grinding rollers 4, 16 with respect to one another may be the same or set at a differential when a diameter of the fixed drive wheel 31 is selected to be different from a diameter of the adjustable drive wheel 31.

Figure 8:
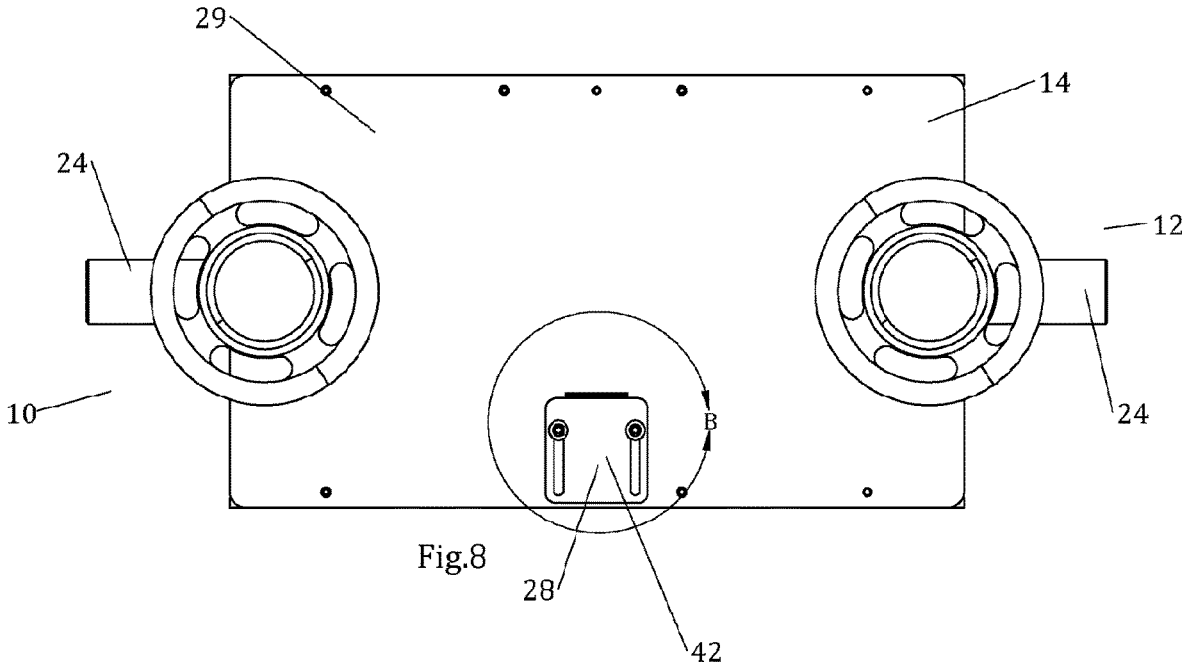
FIG. 8 is a schematic front side view of the roller mill module of FIG. 1.
Figure 9:
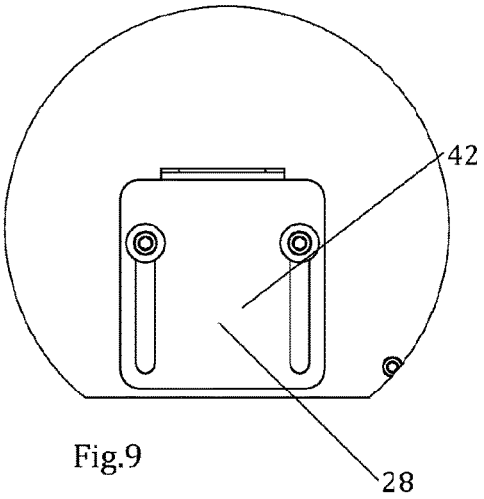
FIG. 9 is a close-up view of area A of FIG. 8.
Figure 10:
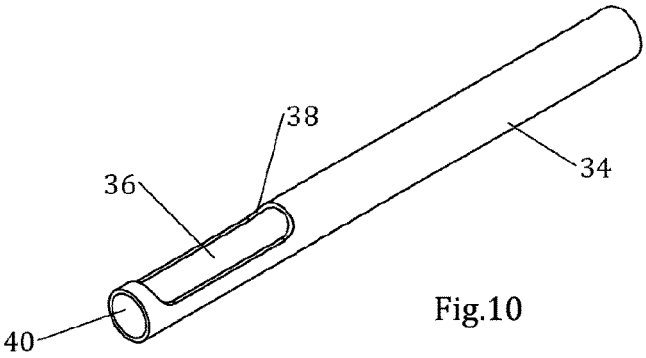
FIG. 10 is a schematic isometric view of an exemplary sampler.
Figure 11:
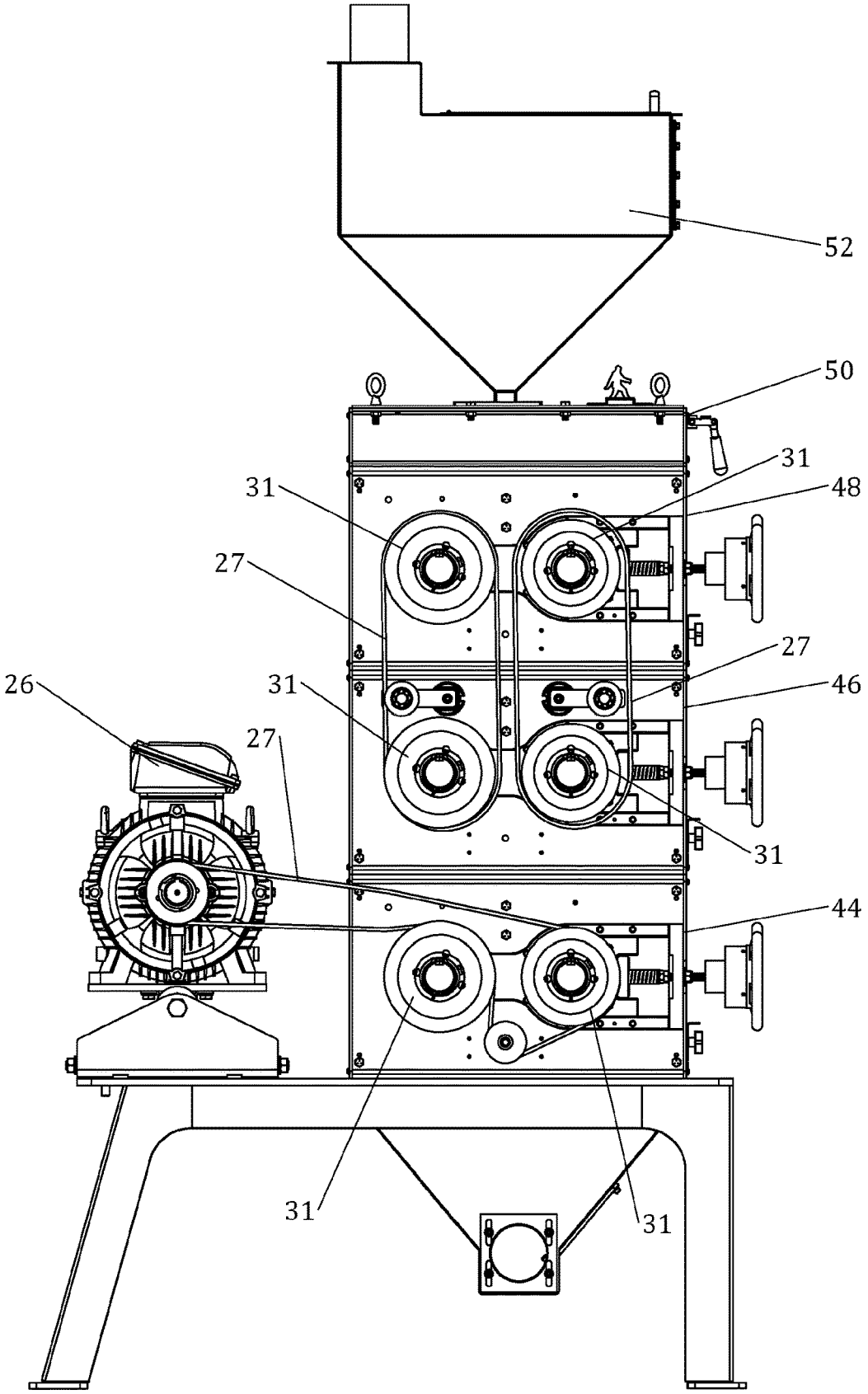
FIG. 11 is a schematic first side view of a three module assembly.
Figure 12:
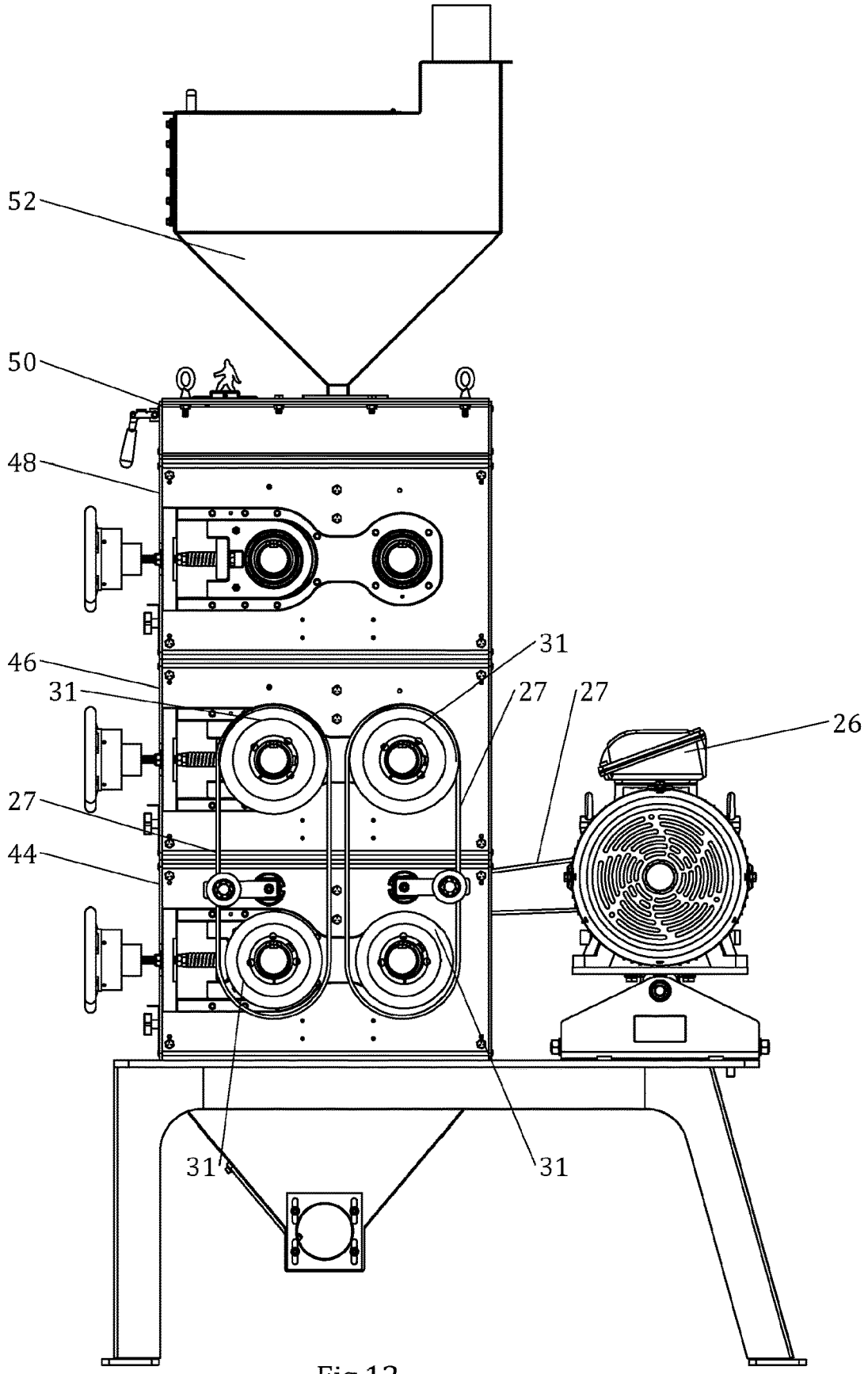
FIG. 12 is a schematic second side view of the assembly of FIG. 11.
Figure 13:
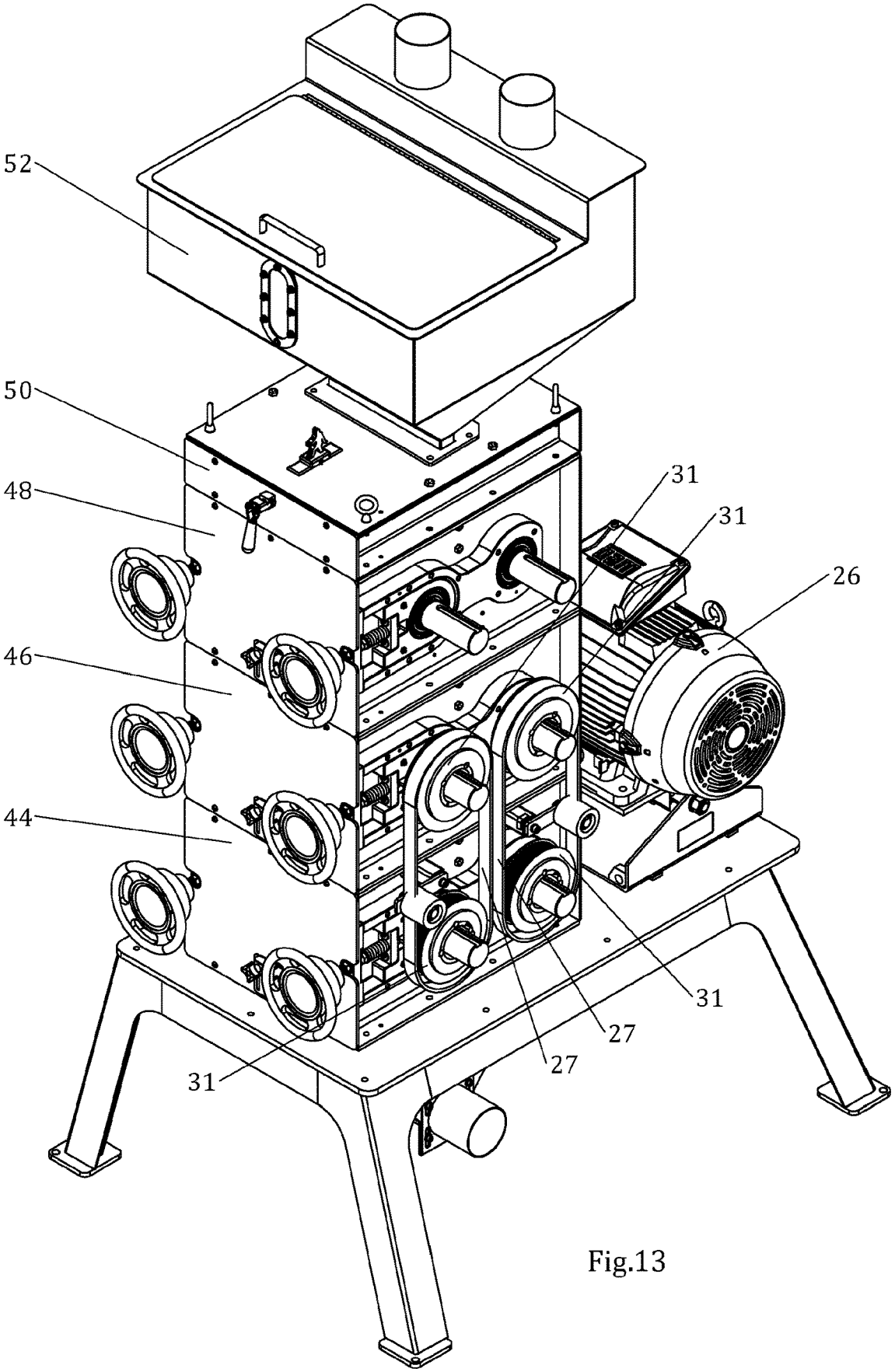
FIG. 13 is a schematic isometric view of the assembly of FIG. 11.
Figure 14:
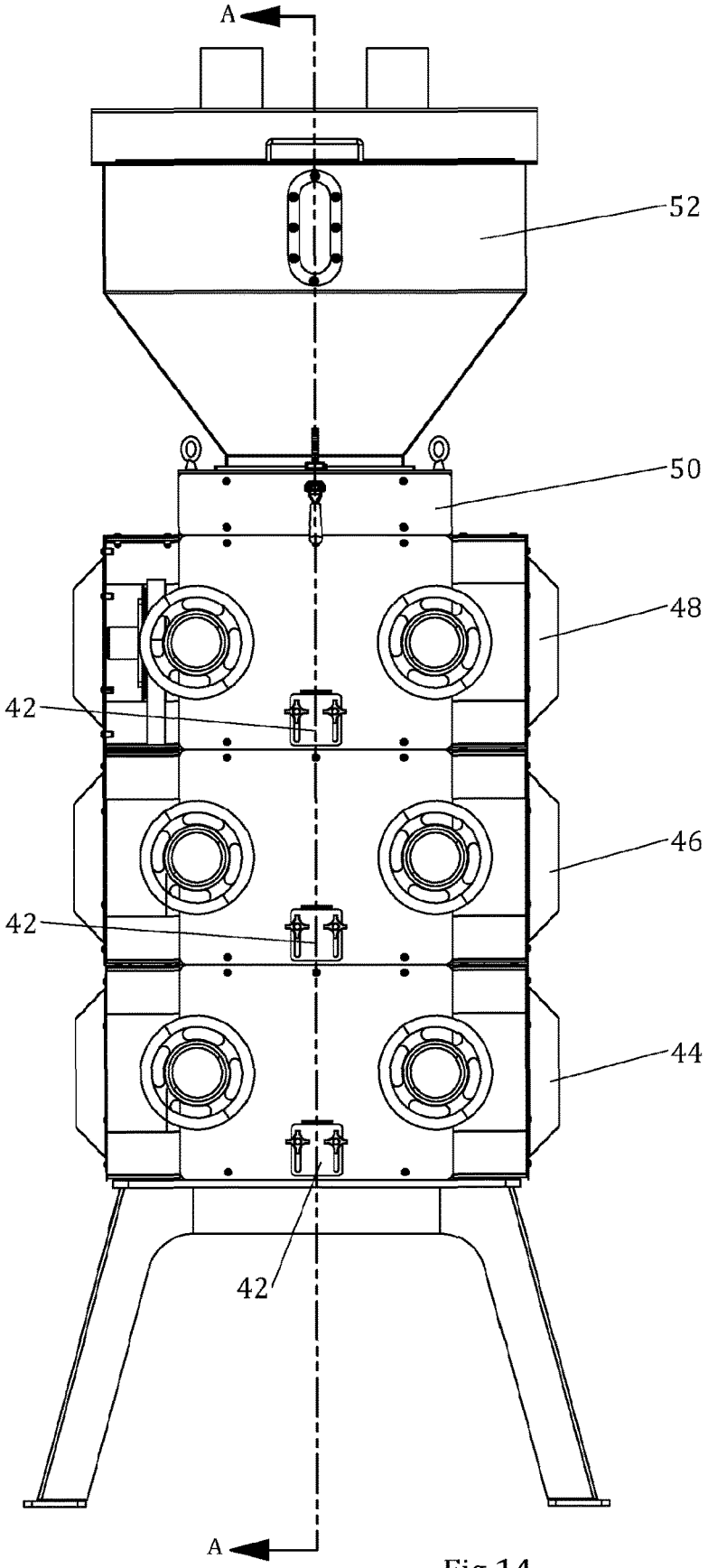
FIG. 14 is a schematic front side view of the assembly of FIG. 11.

To adjust the motor 26 speed and/or grind gap 18 for a desired product grind, the current product grind may be sampled via a sample port 28 (See FIGS. 8 and 9) provided in a front side 29 of the support structure 14 that is coupled to a sample passage 30 extending to a position below the grind area 8 and opposite a sampler stop surface 32. As shown in FIG. 9, a sample cavity 36 formed by a cut-out 38 in a sampler 34 is filled with the current product grind passing through the grind gap 18 when the sampler 34 is inserted through the sample port 28 and sample passage 30 to contact the sampler stop surface 32. For ease of emptying the sampler 34, the sampler 34 may be provided with an open end 40. A cover 42, operable to open and close access to the sample port 28 may be provided to close/seal the sample port 28 when not in use.

The roller mill module may be used as a stand alone unit or as an assembly of roller mill modules. For example, FIGS. 5-7 show two roller mill modules mated together as bottom and middle mill modules 44, 46. The bottom mill module 44 drives the middle mill module 46 via additional belts 27 and drive wheels 31 at the second drive ends 12 of the respective drive shafts 24. The drive shaft 24 of the fixed grinding roller 4 of the bottom mill module 44 is coupled to the drive shaft 24 of the fixed grinding roller 4 of the middle mill module 46 outboard of the second drive ends 12 of the support structures 14 of the bottom and middle mill modules 44,46. Similarly, the drive shaft 24 of the adjustable grinding roller 16 of the bottom mill module 44 is coupled to the drive shaft 24 of the adjustable grinding roller 16 of the middle mill module 46 outboard of the second drive ends 12 of the support structures 14 of the bottom and middle mill modules 44, 46.

Further roller mill modules may be added as desired. For example, FIGS. 11-15 show three roller mill modules mated together as bottom, middle and top mill modules 44, 46, 48. The middle mill module 46 drives the top mill module 48 via additional belts 27 and drive wheels 31 at the first drive ends 10 of the respective drive shafts 24. The drive shaft 24 of the fixed grinding roller 4 of the middle mill module 46 is coupled to the drive shaft 24 of the fixed grinding roller 4 of the top mill module 48 outboard of the first drive ends 10 of the support structures 14 of the middle and top mill modules 46, 48. Similarly, the drive shaft 24 of the adjustable grinding roller 16 of the middle mill module 46 is coupled to the drive shaft 24 of the adjustable grinding roller 16 of the top mill module 48 outboard of the first drive ends 10 of the support structures 14 of the middle and top mill modules 46, 48.

Utilization of the drive shafts 24 alternating between the first and second drive ends 10, 12 balances the loads upon the fixed and adjustable grinding rollers 4, 16, improving overall wear characteristics of the assembly. Further, assembly/maintenance is simplified, as any of the belts 27 may be accessed, without disturbing other belts 27.

The modularity of the roller mill module 2 enables initial acquisition with a minimum capital investment that need not be wasted when further capacity or functionality is required. For example, as the needs of the brewer grow, in addition to adding additional roller mill modules 2 to enable single pass progressive milling, blast gates 50 and/or hoppers 52, including weigh cell metering hoppers, may be easily added without requiring replacement of the original roller mill module.

Further, should maintenance be required, a single roller mill module 2 with an issue may be quickly exchanged by staff with minimal mechanical abilities/training.

Table of Parts

| | |
|---|---|
| 2 | roller mill module |
| 4 | fixed grinding roller |
| 6 | grind surface |
| 7 | groove |
| 8 | grind area |
| 9 | baffle |
| 10 | first drive end |
| 12 | second drive end |
| 14 | support structure |
| 16 | adjustable grinding roller |

-continued

Table of Parts

| | |
|---|---|
| 18 | grind gap |
| 20 | screw |
| 22 | stop surface |
| 23 | spring |
| 24 | drive shaft |
| 26 | motor |
| 27 | belt |
| 28 | sample port |
| 29 | front side |
| 30 | sample passage |
| 31 | drive wheel |
| 32 | sampler stop surface |
| 34 | sampler |
| 36 | sample cavity |
| 38 | cut-out |
| 40 | open end |
| 42 | cover |
| 44 | bottom mill module |
| 46 | middle mill module |
| 48 | top mill module |
| 50 | blast gate |
| 52 | hopper |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A roller mill, comprising:

a fixed grinding roller with a first grind surface rotatably supported within a grind area between a first drive end and a second drive end of a support structure;

an adjustable grinding roller with a second grind surface rotatably supported within the grind area; the adjustable grinding roller movable with respect to the fixed grinding roller to adjust a grind gap between the first grind surface and the second grind surface;

a drive shaft of the fixed grinding roller and a drive shaft of the adjustable grinding roller extending from the first and the second drive ends of the support structure;

a sample port provided in a front side of the support structure; a sample passage coupled to the sample port extending to a position below the grind area and opposite a sampler stop surface; and a sampler configured to insert through the sample port and sample passage to contact the sampler stop surface;

the sampler provided with a cut-out which forms a sample cavity below the grind gap when the sampler contacts the sampler stop surface.

2. The roller mill of claim 1, further including grooves provided in the first grind surface, the grooves skewed with respect to a longitudinal axis of the fixed grinding roller.

3. The roller mill of claim 1, further including a motor coupled to the drive shaft of the fixed grinding roller and the drive shaft of the adjustable grinding roller outboard of the first drive end of the support structure.

4. The roller mill of claim 3, wherein the motor is coupled via a drive belt engaging a fixed drive wheel provided on the drive shaft of the fixed grinding roller and an adjustable drive wheel provided on the drive shaft of the adjustable grinding roller.

5. The roller mill of claim 4, wherein a diameter of the fixed drive wheel is different from a diameter of the adjustable drive wheel.

6. The roller mill of claim 1, wherein the adjustable grinding roller is biased against a stop surface by a spring.

7. The roller mill of claim 6, wherein threading a screw moves the stop surface, to adjust the grind gap.

8. The roller mill of claim 1, further including a cover operable to open and close access to the sample port.

9. The roller mill of claim 1, further including baffles extending between the first and second drive ends which define the grind area therebetween.

10. The roller mill of claim 1, wherein the sampler has an open end.

11. A modular roller mill assembly, comprising two roller mills according to claim 1, the support structures of the roller mills mounted one to another in a stack defining a bottom mill module, and a middle mill module;

a motor coupled to the drive shaft of the fixed grinding roller and the drive shaft of the adjustable grinding roller outboard of the first drive end of the support structure of the bottom mill module;

the drive shaft of the fixed grinding roller of the bottom mill module coupled to the drive shaft of the fixed grinding roller of the middle mill module outboard of the second drive ends of the support structures of the bottom and middle mill modules; and the drive shaft of the adjustable grinding roller of the bottom mill module coupled to the drive shaft of the adjustable grinding roller of the middle mill module outboard of the second drive ends of the support structures of the bottom and middle mill modules.

12. A modular roller mill assembly, comprising three roller mills according to claim 1, the support structures of the roller mills mounted one to another in a stack defining a bottom mill module, a middle mill module and a top mill module;

a motor coupled to the drive shaft of the fixed grinding roller and the drive shaft of the adjustable grinding roller outboard of the first drive end of the support structure of the bottom mill module;

the drive shaft of the fixed grinding roller of the bottom mill module coupled to the drive shaft of the fixed grinding roller of the middle mill module outboard of the second drive ends of the support structures of the bottom and middle mill modules;

the drive shaft of the adjustable grinding roller of the bottom mill module coupled to the drive shaft of the adjustable grinding roller of the middle mill module outboard of the second drive ends of the support structures of the bottom and middle mill modules;

the drive shaft of the fixed grinding roller of the middle mill module coupled to the drive shaft of the fixed grinding roller of the top mill module outboard of the first drive ends of the support structures of the middle and top mill modules; and the drive shaft of the adjustable grinding roller of the middle mill module coupled to the drive shaft of the adjustable grinding roller of the top mill module outboard of the first drive ends of the support structures of the middle and top mill modules.

13. A roller mill assembly, comprising:

two roller mills; the roller mills mounted one to another in a stack defining a bottom mill module, and a middle mill module;

each of the bottom mill module and the middle mill module comprising:

a fixed grinding roller with a first grind surface rotatably supported within a grind area between a first drive end and a second drive end of a support structure;

an adjustable grinding roller with a second grind surface rotatably supported within the grind area; the adjustable grinding roller movable with respect to the fixed grinding roller to adjust a grind gap between the first grind surface and the second grind surface;

a drive shaft of the fixed grinding roller and a drive shaft of the adjustable grinding roller extending from the first and the second drive ends of the support structure;

a sample port provided in a front side of the support structure; a sample passage coupled to the sample port extending to a position below the grind area and opposite a sampler stop surface;

a motor coupled to the drive shaft of the fixed grinding roller and the drive shaft of the adjustable grinding roller outboard of the first drive end of the support structure of the bottom mill module;

the drive shaft of the fixed grinding roller of the bottom mill module coupled to the drive shaft of the fixed grinding roller of the middle mill module outboard of the second drive ends of the support structures of the bottom and middle mill modules; and the drive shaft of the adjustable grinding roller of the bottom mill module coupled to the drive shaft of the adjustable grinding roller of the middle mill module outboard of the second drive ends of the support structures of the bottom and middle mill modules.

14. The roller mill of claim 13, further including a sampler configured to insert through the sample port and sample passage to contact the sampler stop surface;

the sampler provided with a cut-out which forms a sample cavity below the grind gap when the sampler contacts the sampler stop surface.

15. The roller mill of claim 14, wherein the sampler has an open end.

16. A roller mill assembly, comprising:

three roller mills; the roller mills mounted one to another in a stack defining a bottom mill module, a middle mill module and a top mill module;

each of the bottom mill module, the middle mill module and the top module comprising:

a fixed grinding roller with a first grind surface rotatably supported within a grind area between a first drive end and a second drive end of a support structure;

an adjustable grinding roller with a second grind surface rotatably supported within the grind area; the adjustable grinding roller movable with respect to the fixed grinding roller to adjust a grind gap between the first grind surface and the second grind surface;

a drive shaft of the fixed grinding roller and a drive shaft of the adjustable grinding roller extending from the first and the second drive ends of the support structure;

a sample port provided in a front side of the support structure; a sample passage coupled to the sample port extending to a position below the grind area and opposite a sampler stop surface;

a motor coupled to the drive shaft of the fixed grinding roller and the drive shaft of the adjustable grinding roller outboard of the first drive end of the support structure of the bottom mill module;

the drive shaft of the fixed grinding roller of the bottom mill module coupled to the drive shaft of the fixed grinding roller of the middle mill module outboard of the second drive ends of the support structures of the bottom and middle mill modules;

the drive shaft of the adjustable grinding roller of the bottom mill module coupled to the drive shaft of the adjustable grinding roller of the middle mill module outboard of the second drive ends of the support structures of the bottom and middle mill modules;

the drive shaft of the fixed grinding roller of the middle mill module coupled to the drive shaft of the fixed grinding roller of the top mill module outboard of the first drive ends of the support structures of the middle and top mill modules; and the drive shaft of the adjustable grinding roller of the middle mill module coupled to the drive shaft of the adjustable grinding roller of the top mill module outboard of the first drive ends of the support structures of the middle and top mill modules.

17. The roller mill of claim 16, further including a sampler configured to insert through the sample port and sample passage to contact the sampler stop surface;

the sampler provided with a cut-out which forms a sample cavity below the grind gap when the sampler contacts the sampler stop surface.

18. The roller mill of claim 17, wherein the sampler has an open end.

* * * * *